United States Patent [19]

Davis et al.

[11] 4,289,420

[45] Sep. 15, 1981

[54] WOODEN MAT

[76] Inventors: Marvin L. Davis; Edd C. Davis; Albert R. Green, all of Rte. 1, Box 66, Shubuta, Miss. 39360

[21] Appl. No.: 45,929

[22] Filed: Jun. 6, 1979

[51] Int. Cl.[3] ..... E01C 5/14

[52] U.S. Cl. ..... 404/35; 52/581; 15/238

[58] Field of Search ..... 404/35, 17, 18, 71, 404/46, 36; 52/299, 507, 584, 581; 15/238

[56] References Cited

U.S. PATENT DOCUMENTS

| | | | |
|---|---|---|---|
| 70,514 | 11/1867 | Brown | 404/46 |
| 132,801 | 11/1872 | Chinnock | 404/46 |
| 152,299 | 6/1874 | McCauley | 404/46 X |
| 174,659 | 3/1876 | Brisley | 404/46 |
| 2,335,556 | 11/1943 | Wilson | 404/36 |
| 2,382,789 | 8/1945 | Guignon | 404/36 |
| 2,639,650 | 5/1953 | Robishaw | 404/35 |
| 2,652,753 | 9/1953 | Smith | 52/581 X |
| 2,912,909 | 11/1959 | Hart | 404/36 |
| 3,909,996 | 10/1975 | Ettlinger | 52/581 X |

*Primary Examiner*—Nile C. Byers, Jr.

*Attorney, Agent, or Firm*—Harvey B. Jacobson

[57] ABSTRACT

A wooden mat assembly is disclosed for construction of temporary roadway surfacing, such as can be used to form a roadway or assembled to form a flat platform surface where wheeled or tracked vehicles can be turned around. The wooden mat assembly is formed from interlocking mats, each mat being formed from a plurality of layers or boards, each layer being formed from boards parallel to each other and perpendicular to boards forming the adjacent layer, the layers being fastened together at points of intersection by screw shank nails or other fastening means. The assembled roadway or turn-around has particular utility at or near oil well drilling sites, building construction sites, and the like.

5 Claims, 6 Drawing Figures

WOODEN MAT

BACKGROUND OF THE INVENTION

1. Field of the Invention

The invention relates to temporary roadway construction techniques. More particularly, a wooden mat assembly is disclosed which can be interfitted with other like assemblies to form an easily assembled and easily removable wooden roadway or an extended wooden platform, where the surfacing is stronger and more secure than other known single or multiple layer board construction arrangements.

2. Disclosure Statement

A. P. Hart discloses a portable roadway in U.S. Pat. No. 2,912,909, issued Nov. 17, 1959, made from a plurality of mats resting on a plurality of ties, preferably made from timber including runners and cross-pieces, wherein the roadway can used on rough terrain. In U.S. Pat. No. 2,335,556, patented Nov. 20, 1943 by C. N. Wilson, interlocking decking panels are disclosed for interdigitated coupling of adjacent panels, the panels being made of wood. In U.S. Pat. No. 2,382,789, issued Aug. 14, 1945, E. S. Guignon, Jr. discloses a portable landing apron comprising end rails, side rails, and intermediate rails formed of seasoned hardwood, where the rails are adapted to dovetail for assembly.

SUMMARY OF THE INVENTION

Prior attempts to fashion temporary wooden roadways have failed to achieve the simplicity and efficiency which results from standardized wooden mat assemblies of the present invention. Further, a drawback suffered by prior approaches to solving the problem of constructing temporary wooden roadways has frequently arisen when components settle under heavy loads in soft soil, such as sand, dirt or muck. Further problems often experienced with conventional temporary wooden roads have frequently concerned high labor costs in assembly and removal of such sections.

Accordingly, it is an object of the present invention to provide a wooden mat assembly for construction of temporary roadways or turnarounds.

Another object of the invention is to provide a wooden mat assembly presenting a travelable surface consisting of substantially planar and parallel wood boards oriented generally in the direction intended for travel.

Still another object is to provide a wooden mat assembly structure which interlocks in the longitudinal direction when a plurality of such assemblies are fitted together longitudinally, while also permitting transverse interfitting of the wooden mat assemblies to permit lateral expansion.

Another further object is to provide a wooden mat assembly having a layered structure of closet wood board spacing on the upper layer, with farther apart spacing of boards on one or more lower layers.

Still another further object is to provide a wooden mat assembly offering simplicity of construction and of assembly, with the aim of overall savings in labor costs.

Yet another further object is to provide a wooden mat assembly which provides stable supporting temporary roadway and turnaround platform suitable for use with heavy wheeled or tracked vehicles, and which requires minimum lumber usage in construction.

These, together with some objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
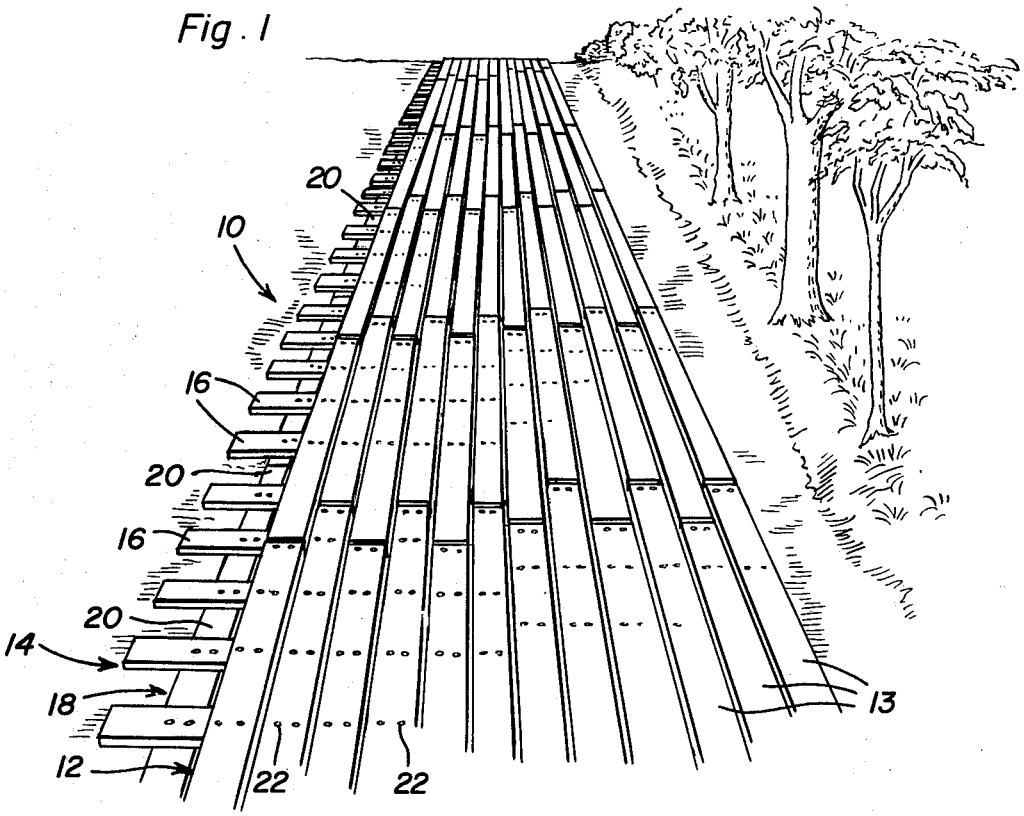
FIG. 1 is a perspective view of a roadway in place formed from a double width of wooden mat assemblies of the present invention, assembled longitudinally to form a roadway of indefinite length.

It is frequently the case that heavy vehicles must be transported in the vicinity of locations of heavy construction, such as, for example, oil well drilling sites, roads to oil well drilling sites, new industrial construction, and the like. Often, the surface environment in such locations is constituted of sand, dirt, or muck in various states of fluidity due to the presence of standing or intermittent surface water, such as exists in poorly drained areas or in areas where water collects during periods of rainfall. Accordingly, the present invention is provided in part to meet the need for temporary roadway and platform surfacing capable of supporting for periods of up to about a year of constant use heavy wheeled or tracked vehicle traffic. Such a construction is illustrated in FIG. 1 by the wooden roadway surface 10, which is made up of surface layer 12, composed of closely spaced longitudinal top wooden planks 13, intermediate layer 14, made up of transverse planks 16 more widely spaced, and underlying layer 18, made up of longitudinal bottom planks 20. The planks of respective layers 12, 14 and 18 are joined together to form wooden mats interfitted together to form wooden roadway surface 10, each mat being fastened by screw shank nails 22.

Figure 2:
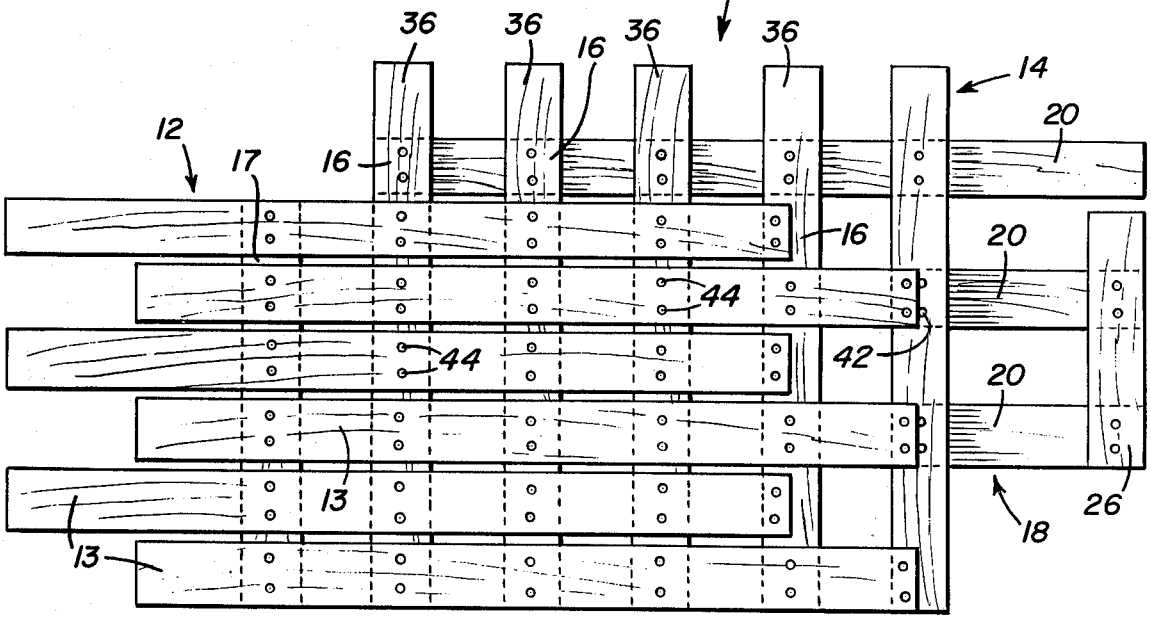
FIG. 2 is a top plan view of a single wooden mat assembly of the present invention.

A single wooden mat 24 is shown in FIG. 2, repetitively assembled to form the wooden roadway surface 10 of FIG. 1. Mat 24 is made up of surface layer 12, comprising substantially parallel longitudinally and closely spaced top wooden planks 13, with intermediate layer 14 supported by underlying layer 18. Additionally, intermediate layer 14 is seen to include short segment 26.

Figure 3:
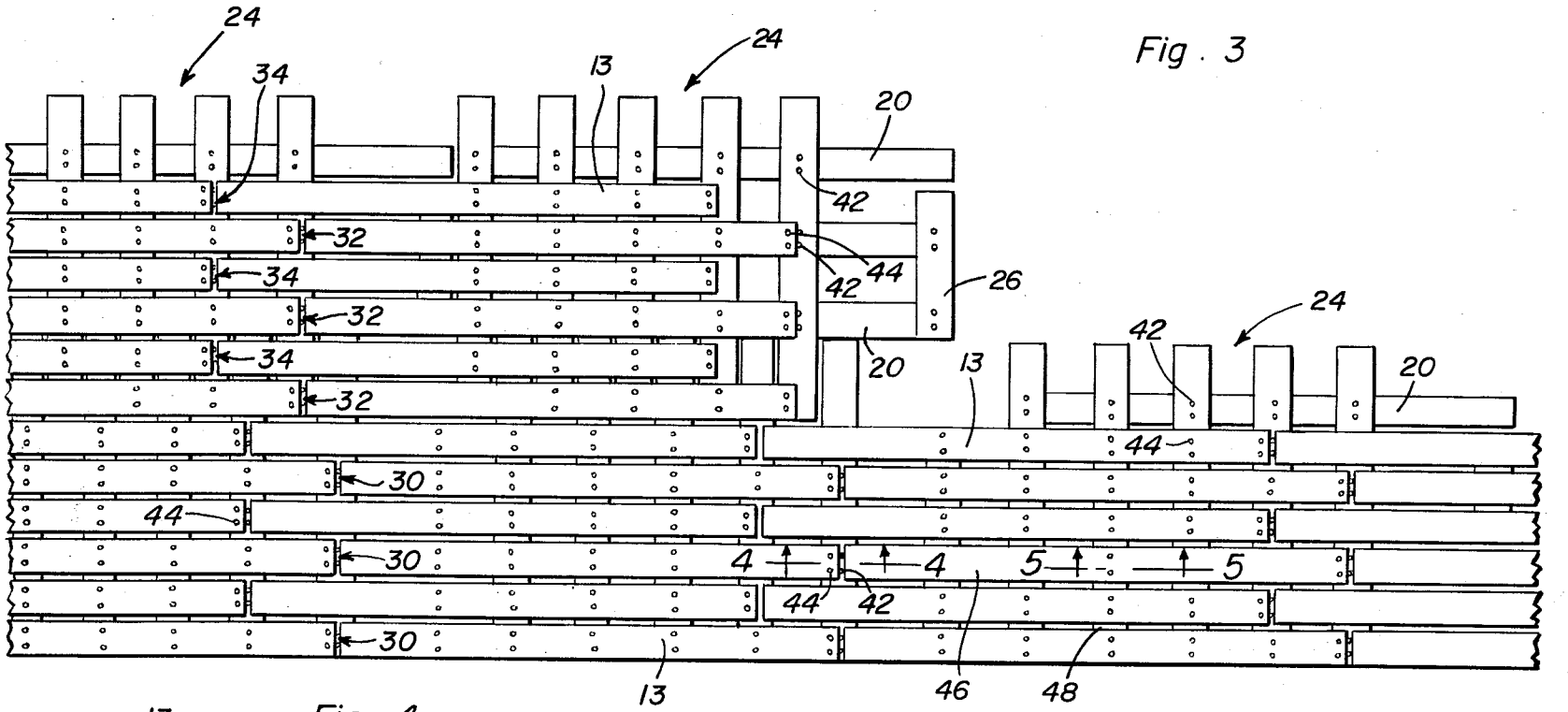
FIG. 3 is a top plan view of a partially assembled roadway comprising a double width of wooden mats of FIG. 2 in the process of assembly to form the roadway of FIG. 1.

In FIG. 3, the relative orientation of wooden mats 24 to form an assembly of interlocking components can be seen.

It is to be particularly noted that short segment 26 is mounted at the end of longitudinal bottom planks 20. With such positioning, short segment 26 provides a stabilizing effect when mats 24 are placed in relatively soft terrain surface, such as sand, dirt or muck, particularly when wet. As longitudinal bottom planks 20 settle in such terrain under the impact of a heavy load traveling on surface layer 12, short segment 26 serves to stabilize the weight carried by mat 24 by preventing longitudinal bottom planks 20 from settling excessively in the surrounding soil.

A further factor contributing to stability of the assembly of FIG. 3 is the offset between each mat 24 interfitted laterally within an adjacent mat 24. For example, joints 30 are offset from joints 32 in FIG. 3. This can be particularly important for promoting stability under the influence of the two front wheels of a vehicle traversing the assembly of FIG. 3, inasmuch as a vehicle moving from left to right will encounter joint 32 before joint 30, with the left front wheel applying its full weight on joints 32 before the right front wheel exerts its downward force on joints 30. Avoidance of simultaneous impact, coupled with extensive transmission and wide distribution of stresses generated by the traveling load, assists in preventing separation of individual mats 24 at their points of interlocking. Further contributing to this stability observed with the use of the invention is the staggered configuration of joints 32 and joints 34, as well as the relatively long lap and the additional support provided by short segment 26.

It is apparent from FIG. 3 that by repeating the assembly of individual wooden mats 24 in interlocking configuration, either laterally or longitudinally, the platform arrangement partially illustrated in FIG. 3 may be repeated indefinitely. However, by rotation of one wooden mat 24 such as that of FIG. 2 through 180° along the ground and interlocking fingers 36 of transverse planks 16, a board road can be formed having six longitudinal planks along each track, with surface planking absent along the central portion of surface layer 12. Omission of the central planking serves to further reduce lumber requirements for use, while widening the roadway for maneuverability.

A further advantageous feature of the invention is the stackability of wooden mats 24 for hauling, temporary storage at a construction site or permanent storage, such as in a warehousing area. Short segment 26 assists in promoting stability of a stack of wooden mats 24, and the substantially square outline of mat 24 makes efficient use of storage space.

Wooden mats 24 of the present invention can be surface treated to impart weather resistance, visibility of the road surface during use, and can be plied in any conventional manner, such as to leave the surface of wooden mat 24 colored green, red, or the like.

Preferably, longitudinal top wooden planks 13, transverse planks 16, and longitudinal bottom blanks 20 are made from rough cut dense hardwood species, preferably selected from oak, hickory, white ash, beech, birch and elm.

EXAMPLE I

A wooden mat 24 was constructed according to FIG. 2 using rough cut oak 2×8 inch planks. Starting with the bottom layer, the assembly had three layers of $\frac{1}{2}\times\frac{1}{2}\times 1$ ply, totaling 2 ply. A total of 261 board feet of lumber was required to form the mat, as well as 69 No. 40 C screw shank nails and 62 No. 30 screw shank nails.

When a number of wooden mats so constructed were assembled to form a roadway, and compared with a conventional hand laid road, it was found that only three individuals were required to lay the wooden mats so constructed, while 15 individuals were required to build the conventional hand laid road. It was further found that the three personnel required to apply the present invention to form a road surface carried out the task in the same or less time than the 15 personnel required to produce the same length of hand laid road. Besides requiring only 1/5 or even less labor cost of assembly, the present invention further was found to save at least 40% in lumber usage as compared to the conventional hand laid roadway.

It was further found that the assembly of wooden mats 24 of the present invention will sustain a load of 180,000 lbs. of track or rubber tire equipment for as long as one year of constant use.

EXAMPLE II

A wooden mat is constructed similar to that of Example I, except that additional transverse planks were inserted in intermediate layer 14 to give a full ply, resulting in a mat of $\frac{1}{2}\times 1\times 1$ ply totaling $2\frac{1}{2}$ ply. Greater structural stability and strength is obtainable, and advantages of sidewise locking are preserved if the additional transverse planks filling center gaps are staggered.

EXAMPLE III

Additional longitudinal bottom planks are placed in bottom layer 18, as well as additional transverse planks in intermediate layer 14. A full 3-ply wooden mat results, having the capability of longitudinal interlocking and having maximum load carrying capacity.

Figure 4:
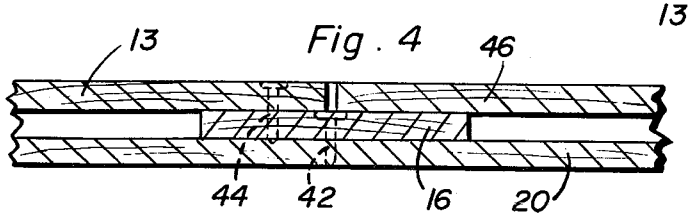
FIG. 4 is a sectional view across a joint of the assembly of FIG. 3, taken substantially upon a plane passing along section line 4—4 on FIG. 3.

FIG. 4 discloses fastening means used for securing the various three layers of wooden mat 24. Nail 42 secures transverse plank 16, seen in section in FIG. 4, to longitudinal bottom plank 20, seen in elevation in FIG. 4. Nail 44 secures longitudinal top wooden plank 13 to transverse plank 16. Longitudinal top wooden plank 46 rests upon transverse plank 16 of the adjacent wooden mat 24.

Figure 5:
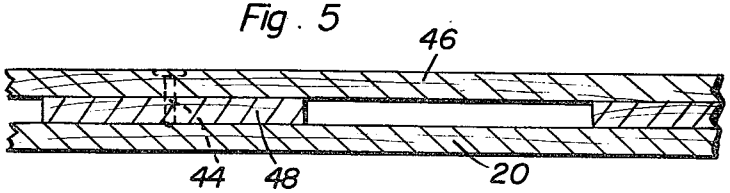
FIG. 5 is a sectional view along an interior portion of the same assembly, taken substantially upon a plane passing along section line 5—5 on FIG. 3.

FIG. 5 shows further details of construction of wooden mat 24 in section, where nail 44 secures longitudinal top wooden plank 46 to transverse plank 48.

Figure 6:
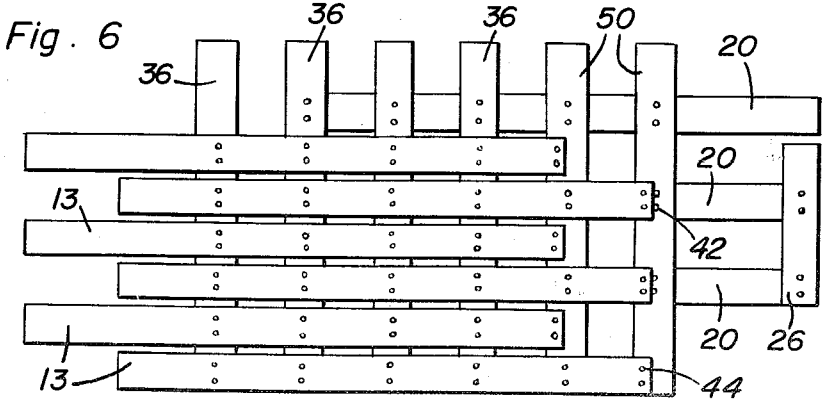
FIG. 6 is a top plan view of a second form of the wooden mat.

FIG. 6 shows yet another form of the invention, differing from that form of FIG. 2 only with respect to one of the transverse planks in intermediate layer 14, all intermediate planks 36 being of equal size, while in FIG. 2, the end transverse plank 17 is somewhat shorter than transverse planks 36.

EXAMPLE IV

A roadway was constructed by placing a pair of wooden mats of FIG. 6 adjacent each other with finger portions 50 interlocking to form a center void having a width of about 20 inches. Individual planks 13 have a width of about 10 inches, and a seventh top plank 13 is provided, the roadway constructed thereby having a total width of about 14 feet. The thickness of the mat is about 8–9 inches. When constructed in such standard shape, an unlimited number of extensions can be incorporated at either end to form a roadway of indefinite length. Moreover, gradual turns are easily provided by systematically bending individual mats in a direction in which the roadway is to turn. Sharp turns can be accommodated by constructing laterally at right angles from the longitudinal path of the roadway.

With use of the present invention, either a square or random run can be created having 1, 2 or 3 sides.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A wooden mat for use in forming a temporary roadway for supporting vehicles, or the like, said mat comprising:

surface layer means directly abuttable with said vehicles, or the like, which may be positioned on said roadway, said surface layer means including a first set of longitudinally-extending, parallelly aligned wooden planks, said first set of planks lying substantially in the same plane and being in a spaced apart relationship to one another which defines a first space therebetween, said first set of planks being substantially formed of planks having equal lengths and being staggered longitudinally with respect to one another whereby the respective ends of planks in said first set of planks do not all lie in the same plane;

intermediate layer means positionable below said surface layer means and being fixedly attached thereto, said intermediate layer means including a second set of planks lying substantially in the same plane and being in a spaced apart relationship to one another which defines a second space therebetween, said second space being utilizable to position planks associated with transversely-located adjacent wooden mats therein in an interdigitated manner which results in an interlocking of said transversely-located adjacent wooden mats to thus prevent relative longitudinal movement therebetween, an offset positioning so as to provide staggered lap joints for increased stability, and a horizontal extension in width of said roadway, said second set of planks being formed substantially of planks having equal lengths and having their respective ends lying in the same plane, said second set of planks being substantially orthogonally positioned with respect to said first set of planks;

end plank means lying in the same plane as said second set of planks and being in parallel, spaced apart alignment therewith, said end plank means comprising a plank having at least one end thereof lying in the same plane as a respective set of ends of said second set of planks and further being directly fixedly connectible to said surface layer means;

lower layer means positionable below said intermediate layer means and being fixedly attached thereto, said lower layer means including a third set of planks lying substantially in the same plane and being in a spaced apart relationship to one another which defines a third space therebetween, said third set of planks being formed substantially of planks having equal lengths and having their respective ends lying in the same plane, said third set of planks being substantially orthogonally positioned with respect to said second set of planks; and short segment means fixedly attached to said lower layer means and orthogonally positioned relative thereto, said short segment means lying in the same plane as said second set of planks and being in parallel alignment therewith, said short segment means being positionable in an interdigitated manner between an end plank means and an intermediate layer means of a longitudinally-located adjacent wooden mat to effect both a longitudinal extension of said roadway and an interlocking of said longitudinally-located adjacent wooden mats to thus prevent relative longitudinal movement therebetween.

2. A wooden mat for use in forming a temporary roadway for supporting vehicles, or the like, said mat comprising:

surface layer means directly abuttable with said vehicles, or the like, which may be positioned on said roadway, said surface layer means including a first set of longitudinally-extending, parallelly aligned wooden planks, said first set of planks lying substantially in the same plane and being substantially formed of planks having equal lengths and being staggered longitudinally with respect to one another whereby the respective ends of planks in said first set of planks do not all lie in the same plane;

intermediate layer means positionable below said surface layer means and being fixedly attached thereto, said intermediate layer means including a second set of planks lying substantially in the same plane and being in a spaced apart relationship to one another which defines a space therebetween, said space being utilizable to position planks associated with traversely-located adjacent wooden mats therein in an interdigitated manner which results in an interlocking of said transversely-located adjacent wooden mats to thus prevent relative longitudinal movement therebetween, an offset positioning so as to provide staggered lap joints for increased stability, and a horizontal extension in width of said roadway, said second set of planks being substantially formed of planks having equal lengths and having their respective ends lying in the same plane, said second set of planks being substantially orthogonally positioned with respect to said first set of planks;

end plank means lying in the same plane as said second set of planks and being in parallel spaced apart alignment therewith, said end plank means comprising a plank having at least one end thereof lying in the same plane as a respective set of ends of said second set of planks and further being directly fixedly connectible to said surface layer means;

lower layer means positionable below said intermediate layer means and being affixedly attached thereto, said lower layer means including a third set of planks lying substantially in the same plane, said third set of planks being formed substantially of planks having equal lengths and having their respective ends lying in the same plane, said third set of planks being substantially orthogonally positioned with respect to said second set of planks; and short segment means fixedly attached to said lower layer means and orthogonally positioned relative thereto, said short segment means lying in the same plane as said second set of planks and being in parallel alignment therewith, said short segment means being positionable in an interdigitated manner between an end plank means and an intermediate layer means of a longitudinally-located adjacent wooden mat to effect both a longitudinal extension of said roadway and an interlocking of longitudinally-located adjacent wooden mats to thus prevent relative longitudinal movement therebetween.

3. A wooden mat for use in forming a temporary roadway for supporting vehicles or the like, said mat comprising:

surface layer means directly abuttable with said vehicles, or the like, which may be positioned on said roadway, said surface layer means including a first set of longitudinally-extending, parallelly aligned wooden planks;

intermediate layer means positionable below said surface layer means and being affixedly attached thereto, said intermediate layer means including a second set of wooden planks;

lower layer means positionable below said intermediate layer means and being affixedly attached thereto, said lower layer means including a third set of wooden planks;

first relative longitudinal movement prevention means associated with said mat for preventing relative longitudinal movement of transversely-located adjacent wooden mats lying in a side-by-side relationship for extending a width of said roadway; and second relative longitudinal movement prevention means associated with said mat for preventing relative longitudinal movement of longitudinally-located adjacent wooden mats lying in an end-to-end relationship for extending a length of said roadway.

4. The wooden mat for use in forming a temporary roadway for supporting vehicles as defined in claim 3, wherein said first relative longitudinal movement prevention means includes an interdigitated positioning of wooden planks associated with said intermediate layer means of transversely-located adjacent wooden mats.

5. The wooden mat for use in forming a temporary roadway for supporting vehicles as defined in claim 4, wherein said second relative longitudinal movement prevention means includes an interdigitated positioning of wooden planks associated with said intermediate layer means of longitudinally-located adjacent wooden mats.

* * * * *